US007638176B2

(12) United States Patent
Kasperchik et al.

(10) Patent No.: US 7,638,176 B2
(45) Date of Patent: Dec. 29, 2009

(54) SEALABLE COATING FOR INK-JET MEDIA

(75) Inventors: Vladek P Kasperchik, Corvallis, OR (US); Gary Allan Ungefug, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 79 days.

(21) Appl. No.: 10/459,861

(22) Filed: Jun. 11, 2003

(65) Prior Publication Data

US 2004/0253392 A1 Dec. 16, 2004

(51) Int. Cl.
*B41M 5/40* (2006.01)

(52) U.S. Cl. ..... 428/32.37; 428/32.27; 428/32.28; 428/32.29; 428/32.34

(58) Field of Classification Search ..... 428/32.28, 428/32.29, 32.3, 32.34, 32.27, 32.37
See application file for complete search history.

(56) References Cited

U.S. PATENT DOCUMENTS

| | | | | |
|---|---|---|---|---|
| 6,001,466 | A | 12/1999 | Noguchi et al. | |
| 6,089,704 | A * | 7/2000 | Burns et al. | 428/32.23 |
| 6,174,663 | B1 * | 1/2001 | Kato | 430/619 |
| 6,357,871 | B1 * | 3/2002 | Ashida et al. | 347/106 |
| 6,550,909 | B2 * | 4/2003 | Ichinose et al. | 347/105 |
| 6,670,000 | B1 * | 12/2003 | Misuda et al. | 428/32.1 |
| 6,686,001 | B2 * | 2/2004 | Gallo et al. | 428/32.36 |
| 6,779,882 | B2 * | 8/2004 | Ungefug et al. | 347/101 |
| 6,833,169 | B2 * | 12/2004 | Kasperchik et al. | 428/32.24 |
| 7,217,447 | B2 * | 5/2007 | Takashima et al. | 428/32.15 |
| 2003/0104177 | A1 | 6/2003 | Kasahara | |
| 2003/0118789 | A1 | 6/2003 | Kasahara | |
| 2003/0186020 | A1 | 10/2003 | Kasahara | |

FOREIGN PATENT DOCUMENTS

| | | |
|---|---|---|
| EP | 1 285 774 A2 | 2/2003 |
| EP | 1 293 354 A2 | 3/2003 |
| EP | 1 346 842 A2 | 9/2003 |
| JP | 63-60784 | 3/1988 |
| JP | S6360784 | 3/1988 |
| JP | 2000326621 | 5/1999 |
| JP | H11301098 | 11/1999 |

* cited by examiner

*Primary Examiner*—Betelhem Shewareged

(57) ABSTRACT

An ink-jet recording media is provided with a sealable coating that is applied to a non-permeable substrate to improve fade resistance, dry time and water resistance. The ink-jet recording media comprises: (a) a non-permeable substrate; (b) a porous basecoat disposed on a surface of the non-permeable substrate, the basecoat comprising at least one pigment, at least one binder, and, optionally, at least one mordant, and adapted to receive a colorant from an ink comprising at least one colorant and a liquid vehicle containing at least one polar solvent; and (c) a porous topcoat. Either (1) the porous basecoat further comprises a solvent-swellable polymer, adapted to swell when contacted by at least one polar solvent of the liquid vehicle, and the porous topcoat is either optional or comprises at least one pigment and at least one binder, or (2) the porous topcoat comprises the solvent-swellable polymer and at least one binder.

40 Claims, 2 Drawing Sheets

SEALABLE COATING FOR INK-JET MEDIA

TECHNICAL FIELD

The present invention relates generally to ink-jet print media, and, more particularly, to improving the properties of an ink-receiving layer applied to a non-absorbent substrate.

BACKGROUND ART

During the ink-jet printing process, an ink vehicle, comprising one or more solvents, and a colorant, such as a dye or pigment, are introduced to the ink-jet receiving layer(s) of an ink-jet recording media. The ink-jet receiving layers absorb the ink vehicle delivered during the printing process. However, when the ink-receiving layer is applied to a non-absorbent substrate, the substrate provides no absorption capacity and as a result, the ink-receiving layer must be the sole absorbing and protective material.

The prior art for ink-jet media used in digital imaging can be classified into two broad groups, porous media and swellable media. The ink-receiving layer of a porous media is based upon the use of a porous inorganic oxide, usually silica or alumina, bound by a polymer binder. During the printing process, ink is quickly absorbed by the physical porosity of the media. The colorant(s) of the ink is(are) bound either by mordants incorporated into the porous layer or by the inorganic oxide surface. The use of porous media offers the advantages of short dry-time, and good smear fastness. However, the use of porous media also has the disadvantage of poor fade resistance.

The ink-receiving layer of a swellable media is based upon the use of a continuous layer of a swellable polymer without physical porosity. During the printing process, ink is absorbed through swelling of the polymer matrix. The colorant or dye of the ink is immobilized inside the continuous layer of the polymer with significantly limited exposure to the outside environment. The use of swellable media offers the advantage of much better fade resistance; however, it has the disadvantages of poor smear fastness and longer dry-time.

Thus, there is a need for an ink-jet recording media that avoids the problems associated with the prior art and provides the advantages of short dry-time, good smear fastness, and improved fade resistance.

DISCLOSURE OF INVENTION

In accordance with the embodiments disclosed herein, an ink-jet recording media is provided with a sealable coating that is applied to a non-permeable substrate to improve fade resistance, dry time and water resistance. The ink-jet recording media comprises:

(a) a non-permeable substrate;

(b) a porous basecoat disposed on a surface of the non-permeable substrate, the basecoat comprising at least one pigment, at least one binder, and, optionally, at least one mordant, and adapted to receive a colorant from an ink comprising at least one colorant and a liquid vehicle containing at least one polar solvent; and (c) a porous topcoat.

Either (1) the porous basecoat further comprises particles of a solvent-swellable polymer, adapted to swell when contacted by at least one polar solvent of the liquid vehicle, and the porous topcoat is either optional or comprises at least one pigment and at least one binder, or (2) the porous topcoat comprises at least one pigment, at least one binder, and the particles of the solvent-swellable polymer.

Further, a process is provided that allows the production of an ink-jet recording media in which the sealable coating is formed, either as part of the porous basecoat or as part of the porous topcoat. The process comprises:

(a) applying the porous basecoat to a surface of the non-permeable substrate, the basecoat either (1) comprising at least one pigment, at least one binder, and particles of the solvent-swellable polymer or (2) comprising at least one pigment and at least one binder;

(b) drying the basecoat; and (c) applying the topcoat to the basecoat, wherein the topcoat is optionally applied in the case of condition (1) or is applied in the case of condition (2) and includes the polymer particles.

The media is subsequently printed on by jetting thereon an ink comprising a colorant and at least one solvent. The ink is absorbed in the basecoat, wherein the solvent swells and plasticizes the polymer particles, either in the basecoat, as in condition (1) or in the topcoat, as in condition (2), thereby forming a seal which encapsulates the dye of the ink within the basecoat.

BEST MODES FOR CARRYING OUT THE INVENTION

Reference is made now in detail to specific embodiments, which illustrate the best mode presently contemplated by the inventors for practicing the invention. Alternative embodiments are also briefly described as applicable.

Figure 1A:
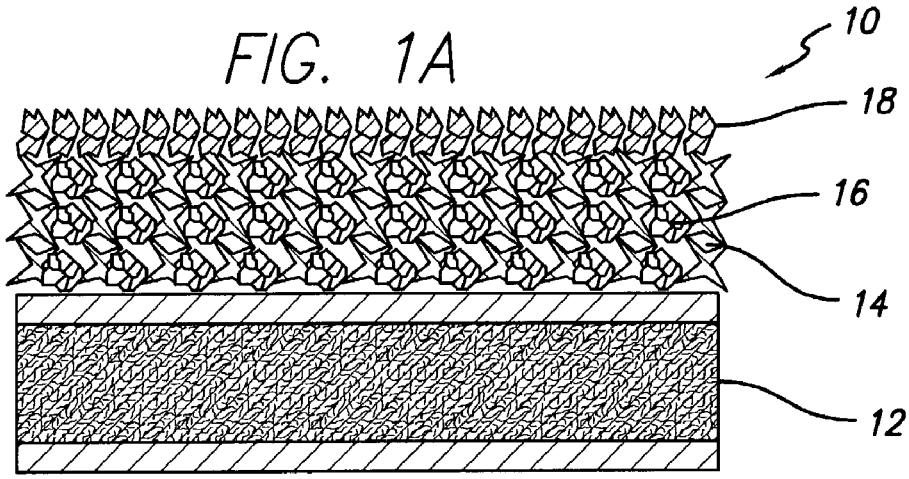
FIG. 1A is a cross-section view of an embodiment of an ink-jet recording media, including a basecoat, prior to the application of an ink.
Figure 1B:
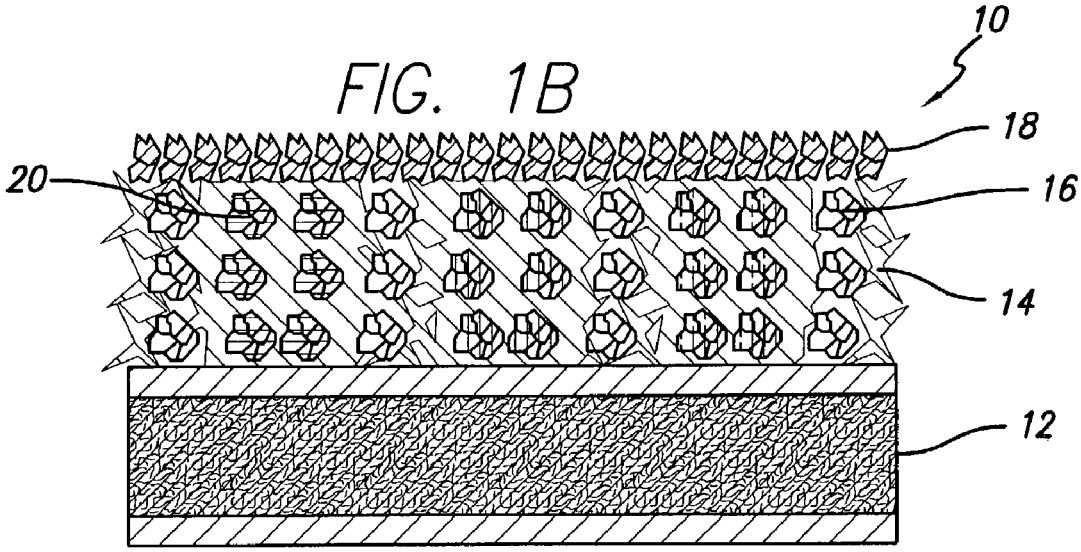
FIG. 1B is a cross-section view of the ink-jet recording media of FIG. 1A, depicting the formation of a seal that encapsulates the dye of the ink within the basecoat.

FIGS. 1A-1B depict a cross-section view of a first embodiment of an ink-jet recording media 10 prior to (FIG. 1A) and after (FIG. 1B) the application of an ink. A porous basecoat 14 comprising one or more pigments (inorganic oxide), one or more binders, and solvent-swellable polymer particles 16 having a glass transition temperature ($T_g$) of at least 50° C. (preferably in the range of 500 to 250° C., and most preferably in the range of about 600 to 160° C.) is applied to a surface of a non-permeable substrate 12. The value of $T_g$ is selected to be higher than any temperature the print media is likely to experience prior to printing, such as during shipment.

The basecoat 14 is dried at an elevated temperature. The use of an elevated temperature is not critical, but it speeds up the media manufacturing process. However, it is important that the elevated temperature not be higher than that of the $T_g$ of the swellable polymer in the media, since it is desirable to avoid sealing the porosity during the drying step.

An ink comprising a colorant 20 and one or more solvents is then applied to the basecoat 14, as shown in FIG. 1B. The solvent of the ink swells and plasticizes the polymer particles 16 of the basecoat 14, thereby forming a seal that encapsulates the colorant 20 of the ink within the basecoat 14.

The substrate 12 comprises a non-permeable (non-air permeable) material, such as a synthetic film, e.g., polyethylene terephthalate, polypropylene, polycarbonate, polyethylene, nylon, Mylar, etc., or a resin-coated paper (e.g., photobase paper, usually paper coated with high or low density polyethylene, polypropylene, or polyester by co-extrusion).

The basecoat 14 comprises one or more pigments, one or more binders, one or more particulate polymers 16, and one or more cationic mordants.

The pigment(s) is(are) selected from the group consisting of porous silica, alumina, hydrates of alumina, titania, zirconia, base metal oxides, carbonates, and glass beads. In order to provide an adequate ink absorbing capacity, it is important that a total pore volume provided by the porous pigments in the layer be in the range from 0.1 to 1.0 $cm^3/g$ of the layer (preferably between 0.4 and 0.6 $cm^3/g$). A higher pore volume results in poor mechanical properties as well as cracking and dusting of the layer. A lower pore volume leads to insufficient ink absorbing capacity and flooding of the media surface with ink during the printing. The major requirement for the inorganic pigment is that it have a hydrophilic surface (so that it will be easily wetted by the aqueous ink) and high surface area (to improve absorption capacity). The basic nature of the binder surface (ability to absorb anions) is an additional bonus because it helps to immobilize anionic dyes (practically all dyes used in the inkjet ink formulations are anionic).

The basecoat and the topcoat, if present, each include one or more binders for the purpose of increasing the coating layer strength. The binder, for example, can be any of a number of water-soluble polymers, such as gelatin, polyvinyl pyrrolidone, water-soluble cellulose derivatives, polyvinyl alcohol or its derivatives, polyacrylamide, polyacrylic acid, different water-soluble acrylic acid co-polymers, etc. Polyvinyl alcohol or its water-soluble/water-dispersible derivatives are the most preferred binder embodiments.

The amount of the binder should be sufficient to bind the pigments and polymer particles 16 together, but low enough to avoid blocking of the physical porosity between particles. The amount of the binder is within the range of about 1 to 50 wt %, preferably about 1 to 10 wt %, with the balance the pigment.

The polymer is a solvent-swellable, water-resistant polymer latex, preferably selected from the group consisting of copolymers of acrylates and methacrylates, polymers based on styrene-acrylics, vinyl acetate-acrylics, vinyl acetate-ethylene, copolymers of acrylonitrile, and the like. The concentration of the polymer in the basecoat is about 5 to 70 wt % of the total basecoat composition, and preferably about 10 to 40 wt %.

The mordant in the basecoat 14 is used to immobilize the colorant 20 within the basecoat 14. Mordants that can be used in the porous layer when the ink dye is anionic include hydrophilic, water-dispersible, or water-soluble polymers having cationic groups (amino, tertiary amino, amidoamino, pyridine, imine, and the like). These cationically-modified polymers can be compatible with water-soluble or water dispersible binders and have little or no adverse effect on image processing or colors present in the image. Suitable examples of such polymers include, but are not limited to, polyquaternary ammonium salts, cationic polyamines, polyamidines, cationic acrylic copolymers, guanidine-formaldehyde polymers, polydimethyl diallylammonium chloride, diacetone acrylamide-dimethyldiallyl ammonium chloride, polyethyleneimine, and a polyethyleneimine adduct with epichlorhydrin. The concentration of the cationic mordant is within the range of about 0.1 to 50 wt %, preferably about 0.1 to 10 wt % of the total basecoat formulation. In some cases, polymeric water-soluble mordants may be used also as the binder (for the basecoat).

A porous topcoat 18 may be applied on the basecoat 14. The porous topcoat 18 comprises the polymer particles 16 and one or more of the binders listed above for the basecoat. The same concentration ranges obtain here as well. The porous topcoat 18 permits penetration of the ink to the basecoat 14.

The polymer particles 16 of the basecoat 14 have a glass-transition temperature $T_g$ well above ambient (at least 50° C., as mentioned above) to prevent fusing of the particles and the resultant loss of physical porosity of the ink-jet recording media prior to printing. During printing, the ink easily penetrates into the porous ink-receiving layer, or the basecoat, 14, where the colorant 20 is trapped either by the presence within basecoat 14 of the mordant or by absorption onto a surface of a pigment such as a porous oxide. Meanwhile, the polymer latex 16 absorbs polar solvents from the ink vehicle and swells. Water evaporation from the printed coating increases the concentration of the polar solvent in the liquid phase and, thus, facilitates a solvent-polymer interaction. The polymer particles 16 absorb the polar solvents, which act like a plasticizer and lower the $T_g$ of the polymer particles to ambient/sub-ambient temperatures. The polymer particles 16 swell and the swollen polymer particles then merge together and locally seal-off the colorant 20 in the area of the basecoat 14 affected by the ink, essentially forming a continuous film. Further slow evaporation of the polar solvent leads to an increase of the polymer $T_g$ and hardens the film formed. For the inks containing water and plasticizing polar solvent, it is imperative that the solvent evaporation rate be at least 1.5 to 2 times slower than that of the water. (Generally, the higher evaporation rate difference, the better.) The resulting localized encapsulation of the colorant 20 shields the colorant from the outside environment and improves fade resistance of the print. The localized encapsulation also reduces the mobility of the colorant 20 and improves humidity robustness of the print.

The solvents employed in the ink formulations comprise one or more organic, water-miscible solvents commonly employed in ink-jet printing. Classes of solvents employed in the practice of this invention include, but are not limited to, aliphatic alcohols, aromatic alcohols, diols, glycol ethers, poly(glycol) ethers, caprolactams, formamides, acetamides, and long chain alcohols. Examples of compounds employed in the practice of this invention include, but are not limited to, primary aliphatic alcohols of 30 carbons or less, primary aromatic alcohols of 30 carbons or less, secondary aliphatic alcohols of 30 carbons or less, secondary aromatic alcohols of 30 carbons or less, 1,2-alcohols of 30 carbons or less, 1,3-alcohols of 30 carbons or less, 1,ω-alcohols of 30 carbons or less, ethylene glycol alkyl ethers, propylene glycol alkyl ethers, poly(ethylene glycol) alkyl ethers, higher homologs of poly(ethylene glycol) alkyl ethers, poly(propylene glycol) alkyl ethers, higher homologs of poly(propylene glycol) alkyl ethers, N-alkyl caprolactams, unsubstituted caprolactams, substituted formamides, unsubstituted formamides, substituted acetamides, and unsubstituted acetamides.

At least one polar organic solvent that plasticizes the polymer particles 16 is employed in the ink formulation. Solvents commonly used as coalescing (film-forming) aids in the latex paint formulations are advantageously employed herein. Specific examples of suitable solvents include, but are not limited to, 1-methyl-2-pyrrolidone, diethylene glycol (DEG) dibutyl ether, DEG monopropyl ether, DEG ethyl ether, 1,2-hexanediol, 2-butoxyethanol, and 2,2,4-trimethyl-1,3-pentanediol mono-isobutyrate, or similar ester-alcohols.

The colorant may comprise any of the dyes or pigments, whether water-miscible, or water-insoluble, or water-dispersible, commonly employed in the art of ink-jet printing. While the media disclosed herein may be used with certain pigment-based inks, preferably, the media disclosed herein is used with dye-based inks, preferably containing anionic dyes.

Summarizing this first embodiment, it is important for the composite inorganic oxide/layer 14 to be porous and have a hydrophilic surface during the printing process. After printing, the polymer particles 16 swell in ink solvents and seal off the areas affected by the ink in order to improve fade resistance and humidity robustness of the print. The various components have the following properties:

(a) the polymer 16 in the ink-receiving layer 14 should have a $T_g$ well above ambient in order to prevent porosity sealing before the printing;

(b) the $T_g$ of the polymer should be reducible to sub-ambient temperatures by swelling in polar solvents in the ink; this will coalesce separate polymer latex particles and result in localized encapsulation of the printed areas;

(c) concomitantly, the polar solvent must be capable of reducing the $T_g$ of the polymer; and (d) the polymer should be solvent-swellable, but water-resistant; water-resistance of the polymer wilt provide enhanced humidity robustness of the print.

Figure 2A:
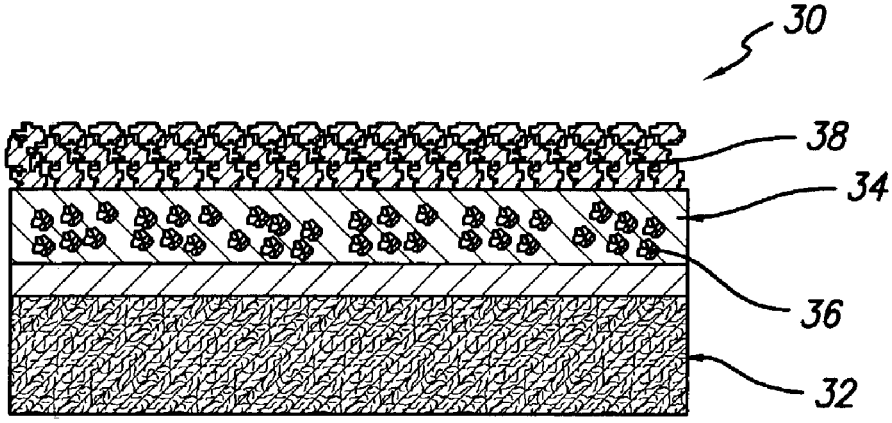
FIG. 2A is a cross-section view of an alternative embodiment of an ink-jet recording media prior to the printing process.
Figure 2B:
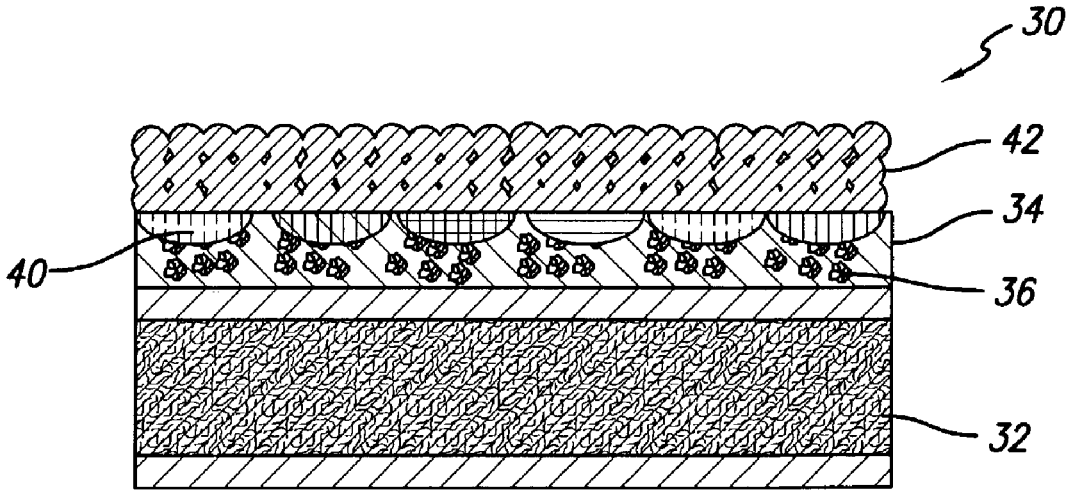
FIG. 2B is a cross-section view of the ink-jet recording media of FIG. 2A, depicting the formation of the self-sealing topcoat embodiments.

In a second embodiment, FIGS. 2A-2B depict a cross-section view of an ink-jet recording media 30 prior to and after the printing process wherein an ink comprising a colorant 40 similar to the colorant 20, above and one or more solvents similar to the solvents referenced above is applied. A porous basecoat 34 with a plurality of pores is applied to the surface of a non-permeable substrate 32. A porous topcoat 38 comprising polymer particles having a glass-transition temperature ($T_g$) of at least 50° C. (preferably at least 60° C.) is applied on the porous basecoat 34. The selection of materials (pigment(s) and binder(s)) for the basecoat 34 is similar to those listed in the first embodiment for the basecoat 14.

An ink having a colorant 40 and one or more solvents is applied to the topcoat 38, but easily penetrates to the basecoat 34. The polar solvent of the ink swells and plasticizes the polymer particles in the topcoat 38 to form a sealed continuous protective film 42 on top of the porous basecoat 34. The colorant 20 is immobilized by mordants in the basecoat 34, as above.

The substrate 32 comprises any of the non-permeable (non-air permeable) materials listed in the first embodiment for the substrate 12. The basecoat 34 comprises one or more pigments and one or more binders, one or more mordants, and a plurality of pores 36, similar to the basecoat 14 above (but without the polymer particles 16). The cationic mordant is used to immobilize the anionic colorant 40 within the basecoat 34. The ink solvent is as listed above.

The topcoat 38 comprises polymer particles of the same composition as the polymer particles 16 described above. The topcoat 38 may also contain an ultraviolet absorber assemblage comprising a combination of benzophenone and hindered amine species. The basecoat 34 and topcoat 38 each contain one or more binders, as mentioned above in connection with the first embodiment. The concentration range of binder in the topcoat 38 is the same as in the basecoat 34 or in the first embodiment.

The polymer particles of the topcoat 38 have a glass-transition temperature $T_g$, here, at least 50° C., as above, for the same reasons. One or more of the ink solvents react with the polymer particles. The polymer particles absorb the solvent which, acting like a plasticizer, lowers the $T_g$ of the polymer particles to ambient/sub-ambient temperatures and promotes the formation of a sealed continuous film on top of the porous basecoat.

In accordance with the embodiments disclosed herein, a process is provided that allows the production of an ink-jet recording media in which a sealable coating can be applied to a non-permeable substrate to improve fade resistance, dry time and water resistance. Specifically, the process comprises:

(a) applying the porous basecoat to a surface of the non-permeable substrate, the basecoat either (1) comprising at least one pigment, at least one binder, solvent-swellable polymer particles, and at least one mordant, or (2) comprising at least one pigment and at least one binder;

(b) drying the basecoat; and (c) applying the topcoat to the basecoat, wherein the topcoat is optionally applied in the case of condition (1) or is applied in the case of condition (2) and comprises at least one pigment, at least one binder, and the polymer particles.

In either embodiment, the print media is subsequently printed on by applying an ink comprising a colorant and at least one polar solvent to the basecoat, wherein the solvent swells and plasticizes the polymer particles, either in the basecoat, as in the first embodiment, or in the topcoat, as in the second embodiment, thereby forming a seal which encapsulates the dye of the ink within the basecoat.

Advantages over what has been done before include the use of a porous basecoat including polymer particles with a $T_g$ of greater than 50° C. or the use of a topcoat including the polymer particles with a $T_g$ greater than 50° C. The basecoat quickly absorbs the ink having the solvent that swells and plasticizes the polymer particles to form a seal that encapsulates the ink colorant within the basecoat.

INDUSTRIAL APPLICABILITY

The use of solvent-swellable polymer particles in either the basecoat or the topcoat, as disclosed herein, is expected to find use in ink-receiving coatings on non-absorbent substrates.

What is claimed is:

1. An ink-jet recording media provided with a sealable coating that is applied to a non-permeable substrate to improve fade resistance, dry time and water resistance, the ink-jet recording media comprising:

(a) the non-permeable substrate;

(b) a porous basecoat disposed on a surface of the non-permeable substrate, the basecoat comprising at least one pigment, at least one binder, particles of a solvent-swellable polymer selected from a water-resistant polymer latex, and at least one cationic mordant selected from the group consisting of hydrophilic, water-dispersible, and water-soluble polymers having cationic groups selected from the group consisting of amino, tertiary amino, amidoamino, pyridine, and imine groups, wherein the particles of the solvent-swellable polymer swell when contacted by at least one polar solvent of an ink-jet ink; and (c) a porous topcoat comprising particles of the solvent-swellable polymer and at least one binder, the solvent-swellable polymer particles having a $T_g$ above ambient that is reduced to ambient/sub-ambient temperature when the solvent-swellable polymer absorbs the at least one polar solvent, whereby a colorant of the ink-jet ink is encapsulated within the basecoat at the ambient/sub-ambient temperature.

2. The ink-jet recording media of claim 1 wherein the at least one pigment of the basecoat is selected from highly porous silica, alumina, hydrates of alumina, titania, zirconia, base metal oxides, carbonates, and glass beads.

3. The ink-jet recording media of claim 1 wherein the at least one binder of the basecoat and the topcoat are independently selected from gelatin, polyvinyl pyrrolidone, water-soluble cellulose derivates, polyvinyl alcohol and its derivatives, polyacrylamide, polyacrylic acid, and water-soluble acrylic acid co-polymers.

4. The ink-jet recording media of claim 1 wherein the solvent-swellable polymer are present in the basecoat in an amount ranging from about 5 wt % to about 70 wt % of the total basecoat composition.

5. The ink-jet recording media of claim 4 wherein the solvent-swellable polymer particles are present in the basecoat in an amount ranging from about 10 wt % to about 40 wt %.

6. The ink-jet recording media of claim 1 wherein the at least one cationic mordant is selected from polyquaternary ammonium salts, cationic polyamines, polyamidines, cationic acrylic copolymers, guanidine-formaldehyde polymers, polydimethyl diallylammonium chloride, diacetone acrylamide-dimethyldiallyl ammonium chloride, polyethyleneimine, and a polyethyleneimine adduct with epichiorhydrin, and combinations thereof.

7. The ink-jet recording media of claim 1 wherein the at least one cationic mordant is present in an amount ranging from about 0.1 wt % to about 50 wt % of the total basecoat formulation.

8. The ink-jet recording media of claim 7 wherein the at least one cationic mordant is present in an amount ranging from about 0.1 wt % to about 10 wt % of the total basecoat formulation.

9. The ink-jet recording media of claim 1 wherein the at least one binder in the basecoat is present in an amount ranging from about 1 wt % to about 50 wt %.

10. The ink-jet recording media of claim 9 wherein the at least one binder in the basecoat is present in an amount ranging from about 1 wt % to about 10 wt %.

11. The ink-jet recording media of claim 1 wherein the solvent-swellable polymer particles have a $T_g$ above 50° C.

12. The ink-jet recording media of claim 11 wherein the $T_g$ is within a range of about 50° C. to about 250° C.

13. The ink-jet recording media of claim 12 wherein the $T_g$ is within a range of about 60° C. to about 160° C.

14. The ink-jet recording media of claim 1 wherein the at least one binder in the topcoat is present in an amount ranging from about 1 wt % to about 50 wt % and the balance is the solvent-swellable polymer particles.

15. The ink-jet recording media of claim 14 wherein the at least one binder in the topcoat is present in an amount ranging from about 1 wt % to about 10 wt % and the balance is the solvent-swellable polymer particles.

16. The ink-jet recording media of claim 1 wherein the at least one polar solvent plasticizes the solvent-swellable polymer particles.

17. The ink-jet recording media of claim 16 wherein the polar solvent is selected from 1-methyl-2-pyrrolidone, diethylene glycol (DEG) dibutyl ether, DEG monopropyl ether, DEG ethyl ether, 1,2-hexanediol, 2-butoxyethanol, and 2,2,4-trimethyl-1,3-pentanediol mono-isobutyrate.

18. The ink-jet recording media of claim 1 wherein the colorant is a dye.

19. The ink-jet recording media of claim 1 wherein the topcoat further includes an ultraviolet absorber.

20. The ink-jet recording media of claim 19 wherein the ultraviolet absorber includes a combination of benzophenone and a hindered amine species.

21. The ink-jet recording media of claim 1 wherein the solvent-swellable polymer particles are capable of being swollen and plasticized by the at least one polar solvent, thereby forming a seal which encapsulates the colorant within said the basecoat.

22. The ink-jet recording media of claim 1 wherein the solvent-swellable polymer particles have an initial $T_g$ of at least about 50° C. that is reducible to ambient/sub-ambient temperature by swelling in said the polar solvent.

23. The ink-jet recording media of claim 1 wherein the water-resistant polymer latex is selected from copolymers of acrylates, copolymers of methacrylates, polymers based on styrene-acrylics, polymers based on vinyl acetate-acrylics, copolymers of acrylonitrile, and combinations thereof.

24. The ink-jet recording media of claim 1 wherein the at least one cationic mordant is a species separate from the at least one pigment, the at least one binder, and the particles of the solvent-swellable polymer of the porous basecoat.

25. A printed ink-jet recording system, comprising:

an ink-jet ink including:

an anionic colorant; and an ink vehicle having a polar solvent; and an ink-jet recording media configured to have the ink-jet ink printed thereon, the ink-jet recording media including:

a non-permeable substrate;

a porous basecoat disposed on a surface of the non-permeable substrate, the basecoat including at least one pigment, at least one binder, particles of a solvent-swellable polymer selected from a water-resistant polymer latex, and at least one cationic mordant selected from hydrophilic polymers, water-dispersible polymers, water-soluble polymers, or combinations thereof, wherein the cationic mordant has cationic groups selected from amino groups, tertiary groups, amidoamino groups, pyridine groups, imine groups, and combinations thereof, and wherein the particles of the solvent-swellable polymer swell when contacted by the polar solvent; and a porous topcoat including particles of the solvent-swellable polymer and at least one binder, the solvent-swellable polymer particles having a $T_g$ above ambient that is reducible to ambient/sub-ambient temperature by swelling when the solvent-swellable polymer particles absorb the polar solvent, whereby the anionic colorant is encapsulated within the basecoat at the ambient/sub-ambient temperature.

26. The printed ink-jet recording system of claim 25 wherein the at least one pigment of the basecoat is selected from highly porous silica, alumina, hydrates of alumina, titania, zirconia, base metal oxides, carbonates, and glass beads.

27. The printed ink-jet recording system of claim 25 wherein the at least one binder of the basecoat and the topcoat are independently selected from gelatin, polyvinyl pyrrolidone, water-soluble cellulose derivates, polyvinyl alcohol, derivatives of polyvinyl alcohol, polyacrylamide, polyacrylic acid, and water-soluble acrylic acid copolymers.

28. The printed ink-jet recording system of claim 25 wherein the solvent-swellable polymer particles are present in the basecoat in an amount ranging from about 5 wt % to about 70 wt %.

29. The printed ink-jet recording system of claim 25 wherein the at least one cationic mordant is selected from polyquaternary ammonium salts, cationic polyamines, polyamidines, cationic acrylic copolymers, guanidine-formaldehyde polymers, polydimethyl diallylammonium chloride, diacetone acrylamide-dimethyldiallyl ammonium chloride, polyethyleneimine, and a polyethyleneimine adduct with epichlorhydrin.

30. The printed ink-jet recording system of claim 25 wherein the at least one cationic mordant is present in an amount ranging from about 0.1 wt % to about 50 wt %.

31. The printed ink-jet recording system of claim 25 wherein the at least one binder in the basecoat is present in an amount ranging from about 1 wt % to about 50 wt %.

32. The printed ink-jet recording system of claim 25 wherein the solvent-swellable polymer particles have a $T_g$ above about 50° C.

33. The printed ink-jet recording system of claim 32 wherein the solvent-swellable polymer particles have a $T_g$ ranging from about 50° C. to about 250° C.

34. The printed ink-jet recording system of claim 25 wherein the at least one binder in the topcoat is present in an amount ranging from about 1 wt % to about 50 wt %, and the balance is the solvent-swellable polymer particles.

35. The printed ink-jet recording media of claim 25 wherein the at least one polar solvent plasticizes the solvent-swellable polymer particles.

36. The printed ink-jet recording media of claim 35 wherein the polar solvent is selected from 1-methyl-2-pyrrolidone, diethylene glycol (DEG) dibutyl ether, DEG monopropyl ether, DEG ethyl ether, 1,2-hexanediol, 2-butoxyethanol, and 2,2,4-trimethyl-1, 3-pentanediol mono-isobutyrate.

37. The printed ink-jet recording system of claim 25 wherein the anionic colorant is a dye.

38. The printed ink-jet recording media of claim 25 wherein the topcoat further includes an ultraviolet absorber.

39. The printed ink-jet recording system of claim 25 wherein the water-resistant polymer latex is selected from copolymers of acrylates, copolymers of methacrylates, polymers based on styrene-acrylics, polymers based on vinyl acetate-acrylics, and copolymers of acrylonitrile.

40. The ink-jet recording media of claim 25 wherein the at least one cationic mordant is a species separate from the at least one pigment, the at least one binder, and the particles of the solvent-swellable polymer of the porous basecoat.

* * * * *

UNITED STATES PATENT AND TRADEMARK OFFICE

CERTIFICATE OF CORRECTION

PATENT NO. : 7,638,176 B2
APPLICATION NO. : 10/459861
DATED : December 29, 2009
INVENTOR(S) : Vladek P Kasperchik et al.

It is certified that error appears in the above-identified patent and that said Letters Patent is hereby corrected as shown below:

In column 7, line 15, in Claim 4, after "polymer" insert -- particles --.

In column 7, lines 28-29, in Claim 6, delete "epichiorhydrin," and insert -- epichlorhydrin, --, therefor.

In column 8, line 10, in Claim 21, before "the" delete "said".

In column 8, line 14, in Claim 22, before "the" delete "said".

In column 10, line 8, in Claim 36, delete "-1, 3-" and insert -- -1,3- --, therefor.

Signed and Sealed this

Twenty-second Day of June, 2010

David J. Kappos

David J. Kappos
*Director of the United States Patent and Trademark Office*